US008147215B2

(12) United States Patent
Rigal et al.

(10) Patent No.: US 8,147,215 B2
(45) Date of Patent: Apr. 3, 2012

(54) RECIPROCATING-PISTON COMPRESSOR HAVING NON-CONTACT GAP SEAL

(75) Inventors: Michel Rigal, Saint-Arnoult (FR); Gilles Hebrard, Caen (FR)

(73) Assignee: KNORR-BREMSE Systeme fuer Nutzfahrzeuge GmbH, Munich (DE)

( * ) Notice: Subject to any disclaimer, the term of this patent is extended or adjusted under 35 U.S.C. 154(b) by 732 days.

(21) Appl. No.: 12/279,966

(22) PCT Filed: Feb. 20, 2007

(86) PCT No.: PCT/EP2007/001444

§ 371 (c)(1),
(2), (4) Date: Jan. 21, 2009

(87) PCT Pub. No.: WO2007/096127

PCT Pub. Date: Aug. 30, 2007

(65) Prior Publication Data

US 2009/0220364 A1 Sep. 3, 2009

(30) Foreign Application Priority Data

Feb. 20, 2006 (DE) ..... 10 2006 007 743

(51) Int. Cl.
*F04B 1/02* (2006.01)

(52) U.S. Cl. ..... 417/258; 417/244; 417/521; 417/267

(58) Field of Classification Search ..... 417/244, 417/269–272, 266, 267, 395, 258
See application file for complete search history.

(56) References Cited

U.S. PATENT DOCUMENTS

| | | | | |
|---|---|---|---|---|
| 3,902,404 | A * | 9/1975 | Breit | 92/86 |
| 4,761,118 | A * | 8/1988 | Zanarini | 417/254 |
| 5,461,859 | A * | 10/1995 | Beale et al. | 60/517 |
| 5,715,740 | A * | 2/1998 | Sims | 92/128 |
| 6,547,534 | B1 * | 4/2003 | Sakamoto et al. | 417/244 |
| 2006/0254418 | A1 * | 11/2006 | Barbezat | 92/170.1 |

FOREIGN PATENT DOCUMENTS

DE 68 09 596 9/1970

* cited by examiner

*Primary Examiner* — Sikha Roy
(74) *Attorney, Agent, or Firm* — Crowell & Moring LLP

(57) ABSTRACT

A reciprocating-piston compressor having at least two working cylinders arranged in series, along a cylinder axis is described. The compressor includes a piston in each of the cylinders, guided in an axially movable manner, and a common axially actuated piston rod of the pistons, extending through a passage opening in a partition between the at least two working cylinders. The at least two working cylinders are sealed off with respect to one another in a region of the common axially actuated piston rod, exclusively by a non-contact seal. The axial seal has an axial gap seal formed between a radially outer circumferential surface of the common axially actuated piston rod and a radially inner circumferential surface of the passage opening.

6 Claims, 4 Drawing Sheets

RECIPROCATING-PISTON COMPRESSOR HAVING NON-CONTACT GAP SEAL

SUMMARY AND BACKGROUND OF THE INVENTION

The invention includes a reciprocating-piston compressor having at least two working cylinders which are arranged in series and along a cylinder axis and in which in each case one piston is guided in an axially movable manner, with the pistons having a common axially actuated piston rod which extends through a passage opening in a partition between the working cylinders.

In the reciprocating-piston compressors known from the prior art, a contact seal in the form of a sealing ring is conventionally provided between the passage opening and the piston rod, in order to seal off the working cylinders, which are arranged in series, with respect to one another. In particular where reciprocating-piston compressors are used in compressed-air brake systems of utility vehicles such as commercial trucks, a high compressor power is required on account of the high compressed air demand, and the reciprocating-piston compressor must therefore perform a high number of compression strokes. The previously-used contact seals, however, generate friction, such that relatively high friction losses are generated as a result of the high number of compression strokes, which friction losses also manifest themselves in high temperatures of up to 300° C. in the region of the seal. For these reasons, a low-friction and simultaneously heat-resistant material is necessary for the seals, which is correspondingly expensive.

In contrast, the embodiments according to the present invention provide a reciprocating-piston compressor of the type specified above that can be produced more economically.

The invention embodiments provide for sealing off the working cylinders in the region of the piston rod exclusively by using a non-contact seal in the form of an axial gap seal which is formed between a radially outer circumferential surface of the piston rod and a radially inner circumferential surface of the passage bore. In other words, in one example the piston rod extends through the passage opening without the interposition of a separate contact seal. Although a certain degree of leakage then takes place between the working cylinders, the leakage however does not pose a problem in the exemplary design of reciprocating-piston air compressors with at least two working cylinders arranged in series, since each working cylinder is acted on with compressed air in any case. It is then possible for the previously conventional contact seals in the partitions between the working cylinders, which are associated with the disadvantages mentioned in the introduction, to be dispensed with.

The invention utilizes the viscosity properties of the air, on account of which compressed air has a reduced tendency to pass through a narrow gap in the event of a rapid pressure rise than in the event of a relatively slow pressure rise. Against the background of the high number of compression strokes per unit time, and thus the fast pressure rise in the working cylinders, which are conventional with reciprocating-piston air compressors in compressed-air brake systems of utility vehicles, a small amount of leakage is consequently to be expected.

The axially extending annular gap, between the radially outer circumferential surface of the piston rod and the radially inner circumferential surface of the passage bore, forms a throttle at which the gap flow loses pressure energy. The gap, depending on the gap width, consequently reduces a high pressure level to a significantly lower level as a result of the throttling.

It is particularly preferable, to form a labyrinth gap seal, for at least the radially inner circumferential surface of the passage bore to be provided with radial grooves which are arranged with an axial spacing to one another. In a labyrinth gap seal of that type, the fluid flows from a chamber of the one working cylinder, which is at relatively high pressure, into a chamber of the other working cylinder, which is at a relatively low pressure, through a plurality of constricted throttle points which are formed by the constrictions of the passage opening arranged between the grooves. The kinetic energy of the fluid flow is converted almost entirely into friction heat, that is to say into loss energy, in the widened spaces downstream of the throttle points, that is to say in the grooves.

In one preferred exemplary embodiment of the invention, the reciprocating-piston compressor is of reversing design, with the leakage flow which flows through the gap seal from the one working cylinder into the other working cylinder advantageously increasing the air volume which is to be compressed during the subsequent reversing movement of the piston rod.

In one exemplary refinement, the invention may also be applied to a multi-stage reciprocating-piston compressor which performs a multi-stage compression of the intake air and in which each working cylinder is assigned to a compression stage.

The invention is particularly preferably used, for the reasons already stated above, in a reciprocating-piston compressor of a compressed-air brake system of a utility vehicle.

Other objects, advantages and novel features of the present invention will become apparent from the following detailed description of one or more preferred embodiments when considered in conjunction with the accompanying drawings.

BRIEF SUMMARY OF THE DRAWINGS

More precise details are given in the following description.

Exemplary embodiments of the invention are illustrated in the drawing and are explained in more detail in the following description. In the drawings.

DETAILED DESCRIPTION OF THE DRAWINGS

Figure 1:
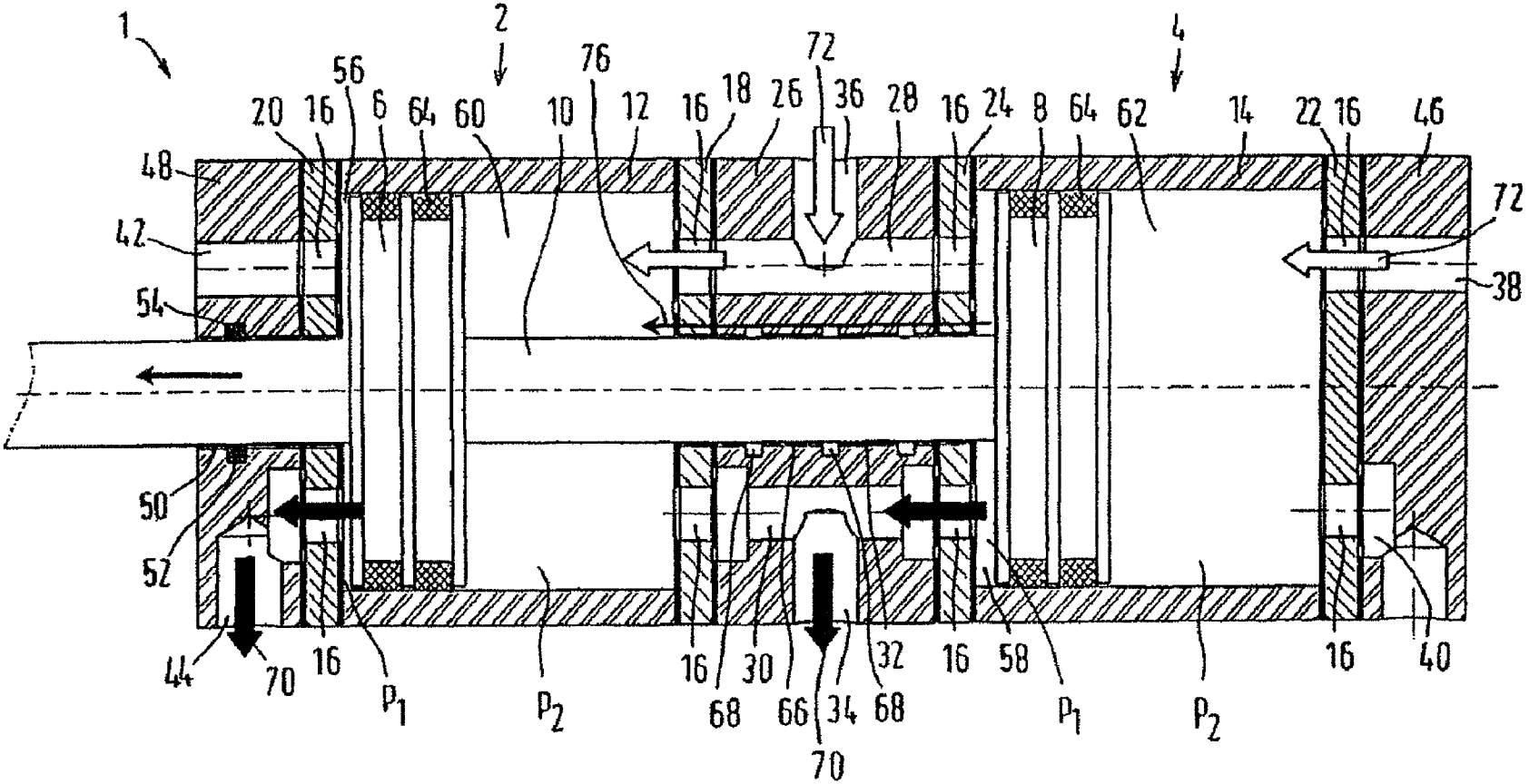
FIG. 1 shows a cross-sectional illustration of a reciprocating-piston compressor according to a preferred embodiment of the invention, in a first position.

The reciprocating-piston compressor 1 shown in the example of FIG. 1 is of the type in which a plurality, preferably two, cylinders 2, 4 are connected in series, with the pistons 6, 8 which are guided axially in the cylinders 2, 4 being connected to a common piston rod 10 which is driven in a reversing fashion by an internal combustion engine (not shown for reasons of scale) of the utility vehicle, in order to generate compressed air for the compressed-air brake system. Here, an independent compression process of the intake air takes place in each of the cylinders 2, 4, without the compressed air generated by the one cylinder 2 being fed into the other cylinder 4 or vice versa.

The two cylinders 2, 4 are composed of, in each case, a casing housing 12, 14, which casing housings 12, 14 are closed off at the end side by base plates 18, 20, 22, 24 which are provided with passage openings 16. Furthermore, a partition 26 is arranged axially between the cylinders 2, 4, in which partition 26 is formed at least one continuous inlet duct 28, and an outlet duct 30, which are aligned with the associated passage opening 16 in the base plates 18, 20, 22, 24 of the cylinders 2, 4, and a passage opening 32 for the piston rod 10. The outlet duct 30 is connected by an outlet connection 34, which runs transversely with respect to the outlet duct 30, to a compressed air reservoir (not shown). The inlet duct 28 is connected by an inlet connection 36, which likewise runs transversely with respect to the inlet duct 28, to the environment.

The passage openings 16 in the base plates 20, 22, which are arranged at those ends of the casing housings 12, 14 which do not face toward the partition 26, are likewise aligned with inlet connections 38, 42 and outlet connections 40, 44 which are formed in end pieces 46, 48 placed axially onto the base plates 20, 22.

Furthermore, a central passage opening 50 for the piston rod 10 is provided in the base plate 20 and in the end piece 48 of the one cylinder 2, which piston rod 10 is in contact with a ring seal 54 which is held in a radially inner groove 52 of the end piece 48. The pistons 6, 8 divide the cylinders 2, 4 in each case into a first cylinder chamber 56, 58 and a second cylinder chamber 60, 62, the sizes of which are dependent on the respective position of the piston 6, 8. The ring seal 54 then serves to seal off the first cylinder chamber 56 of the one cylinder 2 with respect to the environment.

In an additional feature of the exemplary embodiment, the pistons 6, 8 also, on their radially outer circumferential surfaces, support seals 64 which in each case seal off the first cylinder chamber 56, 58 and the second cylinder chamber 60, 62 with respect to one another. The seals 54, 64 described with example above are in each case contact seals, that is to say the seal 54, 64 is in contact with the respectively associated running surface.

In order to seal off the second cylinder chamber 60 of the one cylinder 2 with respect to the first cylinder chamber 58 of the other cylinder 4, however, provision is made not of a contact seal but rather of an axial gap seal 66 which is preferably formed, in the present, as a labyrinth gap seal. In an alternative exemplary embodiment example, a smooth cylindrical or stepped gap seal may be used. In this embodiment, a narrow axial gap 66 is formed between a radially outer circumferential surface of the piston rod 10 and a radially inner circumferential surface of the passage opening 32 of the partition 26, which gap 66 is otherwise also present between the two base plates 18, 24 and the piston rod 10. To form a labyrinth gap seal 66, at least the radially inner circumferential surface of the passage opening 32 of the partition 26 is also provided with radial grooves 68 which are arranged with an axial spacing to one another.

Arrows 70 shown in the exemplary embodiment of FIG. 1, have thick solid lines that are intended to denote the flow path of compressed air; black-bordered arrows 72 are intended to denote the flow path of intake air, black-bordered and hatched arrows 74 are intended to indicate the flow path of air flowing from one cylinder 2, 4 into the other cylinder 2, 4, and arrows 76 with thin lines are intended to denote the flow path of leakage flows. Against this background, the mode of operation of the reciprocating-piston compressor 1 is described below.

During a movement of the piston rod 10 to the left, as per FIG. 1, the volume of the two first cylinder chambers 56, 58 decreases, while that of the two second cylinder chambers 60, 62 simultaneously increase. In this manner, under rising pressure $p_1$, the air situated in the first cylinder chambers 56, 58 is compressed and is ejected via the outlet connections 34, 44, to which is connected an accumulator line (not shown) in order to supply the compressed air to the compressed-air reservoir. The flow movement is denoted in FIG. 1 by the black arrows 70 with thick solid lines.

At the same time, the volume of the second cylinder chambers 60, 62 is increased, as a result of which the pressure $p_2$ there falls and air is drawn in via the inlet connections 36, 38, as denoted by the black-bordered arrows 72. The pressure gradient $dp=p_1-p_2$ between the first cylinder chamber 58 of the other cylinder 4 and the second cylinder chamber 60 of the one cylinder 2 results in a small leakage flow, denoted by a narrow arrow 76, through the gap 66, which however does not pose a problem since it contributes to the filling of the second cylinder chamber 60 of the one cylinder 2 with air, which air is compressed during the subsequent reversing movement of the piston rod 10.

Figure 2:
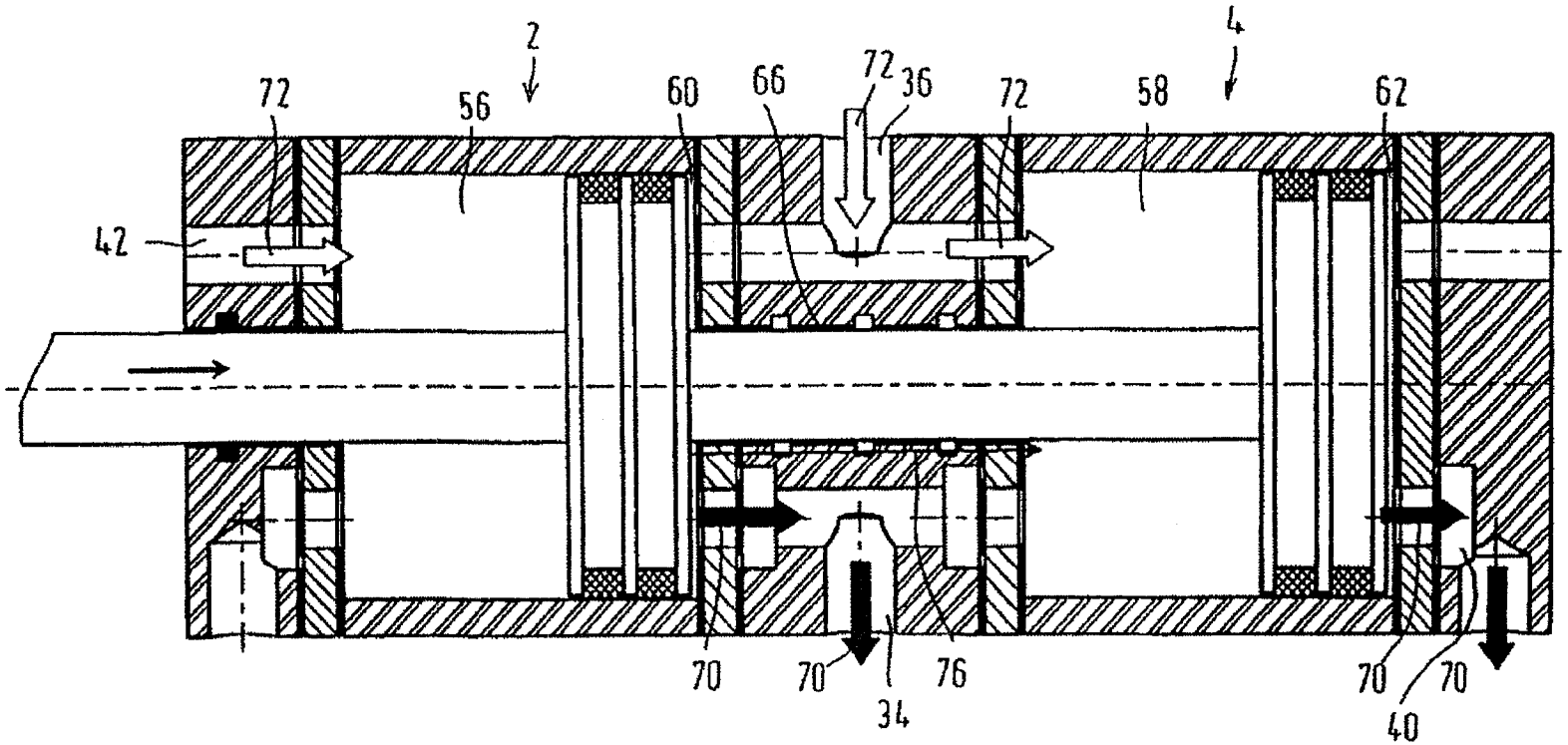
FIG. 2 shows the reciprocating-piston compressor from FIG. 1 in a second position.

During the reversing movement of the piston rod 10, which is shown in FIG. 2, the air which was previously drawn into the second cylinder chambers 60, 62, and also the leakage air 76 which flowed through the gap 66 into the second cylinder chamber 60 of the one cylinder 2, is compressed and is supplied via the outlet connections 34, 40 to the compressed-air reservoir. At the same time, new air is drawn into the first cylinder chambers 56, 58 via the inlet connections 36, 42. As a result, a leakage flow 76 is again generated, now in the opposite direction, through the gap, which leakage flow 76 supplies further air to the first cylinder chamber 58 of the other cylinder 4.

As a result of the reversing movements of the piston rod 10, air is firstly drawn into each cylinder chamber 56, 58, 60, 62 by a volume increase, and the air is compressed and ejected, with both piston surfaces of each piston 6, 8 constituting active surfaces which act in both directions. The leakage flow 76 generated in each case here is however not ejected into the environment, but rather contributes to increasing the air volume which is to be compressed during the subsequent reversing movement of the piston rod 10.

Figure 3:
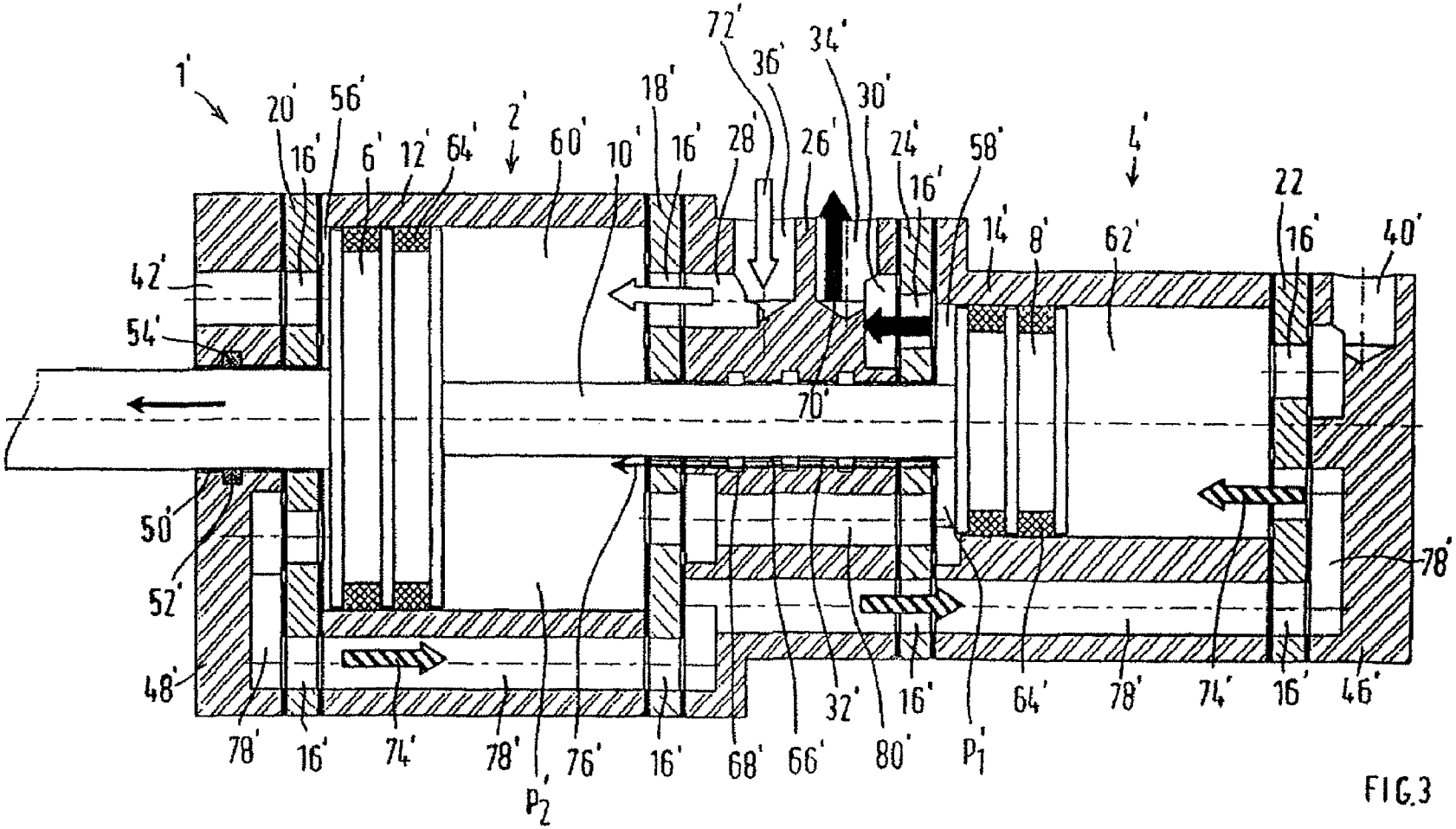
FIG. 3 shows a cross-sectional illustration of a reciprocating-piston compressor according to a further embodiment of the invention, in a first position.
Figure 4:
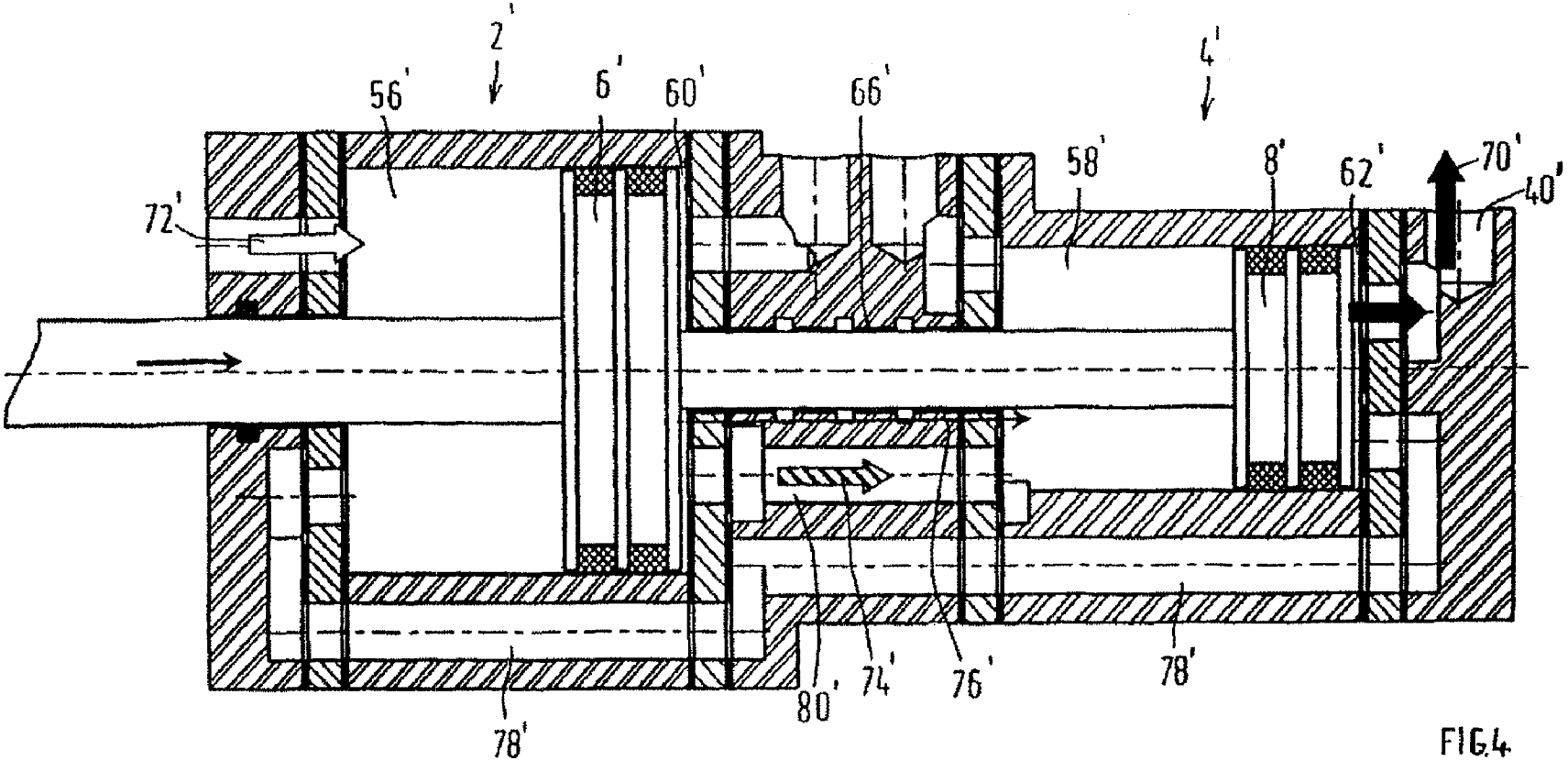
FIG. 4 shows the reciprocating-piston compressor from FIG. 2 in a second position.

In the second exemplary embodiment of the invention as per FIGS. 3 and 4, identical and equivalent parts to those in the preceding example are denoted by the same reference symbols, but in each case with an additional apostrophe. In contrast to the preceding example, the reciprocating-piston compressor 1' is of multi-stage design, that is to say during a stroke, the air which is compressed by the one cylinder 2' in the first cylinder chamber 56' is conducted into the second cylinder chamber 62' of the other cylinder 4', in order to be subjected to a further compression there during the reversing stroke of the piston rod 10', before the compressed air is supplied via the outlet connection 40' to the compressed-air reservoir. The first cylinder chamber 56' of the one cylinder 2' therefore has no outlet connections, but rather is flow-connected by using a compressed-air connection in the form of a compressed-air duct 78 to the second cylinder chamber 62' of the other cylinder 4'. Furthermore, the second cylinder chamber 60' of the one cylinder 2' is connected to the first cylinder chamber 58' of the other cylinder 4' by using an overflow duct 80'.

During a movement of the piston rod 10', shown in FIG. 3 to the left, the air in the first cylinder chamber 56' of the one cylinder 2' is pressurized by the decreasing volume, and is introduced via the compressed-air duct 78' into the second cylinder chamber 62' of the other cylinder 4'. There the air assists the piston movement of the piston 8' which is associated to the cylinder 4' and which compresses the air present in the first cylinder chamber 58' of the cylinder 4' and supplies the air via the outlet connection 34 to the compressed-air reservoir. As a result of the pressure drop between the higher pressure $p_1'$ in the first cylinder chamber 58' of the other cylinder 4' and the pressure $p_2'$, which is relatively low in comparison thereto, in the second cylinder chamber 60' of the one cylinder 2', a small part of the compressed air flows as a leakage flow 76' into the second cylinder chamber 60' of the one cylinder 2'. There, the leakage air assists the piston movement. At the same time, the one cylinder 2' draws in air from the environment into its second cylinder chamber 60' via the inlet connection 36'.

During the reversing movement of the piston rod 10' shown in FIG. 4 to the right, the air which is drawn into the second cylinder chamber 60' of the one cylinder 2' is compressed, and most of the air is pushed via the overflow duct 80' into the first cylinder chamber 58' of the other cylinder 4' in order to there assist the piston movement to the right. At the same time, the piston 8' of the other cylinder 4' compresses the compressed air which is situated in its second cylinder chamber 62', and which has already been pre-compressed by the one cylinder 2', and pushes the compressed air out via the outlet connection 40' into the compressed-air reservoir. According to this exemplary embodiment, the piston 6' of the one cylinder 2' in turn pushes a small leakage flow 76 from the second cylinder chamber 60' into the first cylinder chamber 58' of the other cylinder 4' in order to assist the piston movement of the piston 8' there and in order to provide air for the next compression process.

The following list of reference symbols is provided to assist in understanding the drawings and specification.

1 Reciprocating-piston compressor
2 Cylinder
4 Cylinder
6 Piston
8 Piston
10 Piston rod
12 Casing housing
14 Casing housing
16 Passage openings
18 Base plate
20 Base plate
22 Base plate
24 Base plate
26 Partition
28 Inlet duct
30 Outlet duct
32 Passage opening
34 Outlet connection
36 Inlet connection
38 Inlet connection
40 Outlet connection
42 Inlet connection
44 Outlet connection
46 End piece
48 End piece
50 Passage opening
52 Groove
54 Seal
56 First cylinder chamber
58 First cylinder chamber
60 Second cylinder chamber
62 Second cylinder chamber
64 Seals
66 Gap seal
68 Grooves
70 Arrow
72 Arrow
74 Arrow
76 Arrow
78 Compressed-air duct
80 Overflow duct The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A reciprocating-piston compressor having at least two working cylinders arranged in series, along a cylinder axis, comprising:

a piston in each of the cylinders, guided in an axially movable manner; and a common axially actuated piston rod of the pistons, extending through a passage opening in a partition between the at least two working cylinders, wherein the at least two working cylinders are sealed off with respect to one another in a region of the common axially actuated piston rod exclusively by a non-contact seal, the axial seal comprising an axial gap seal formed between a radially outer circumferential surface of the common axially actuated piston rod and a radially inner circumferential surface of the passage opening, and wherein the reciprocating-piston compressor is a reversing reciprocating-piston compressor, a leakage flow flowing through the axial gap seal from one into another of the at least two working cylinders increasing an air volume compressed during subsequent reversing movement of the axially actuated piston rod.

2. The reciprocating-piston compressor as claimed in claim 1, further comprising radial grooves arranged with an axial spacing relative to one another, disposed on the radially inner circumferential surface of the passage opening, to form a labyrinth gap seal.

3. The reciprocating-piston compressor as claimed in claim 1, wherein the reciprocating-piston compressor is a multi-stage reciprocating-piston compressor for performing multi-stage compression, each working cylinder of the multi-stage reciprocating-piston compressor being assigned to a compression stage.

4. A compressed-air-actuated brake system of a vehicle, comprising:

a reciprocating-piston compressor having at least two working cylinders arranged in series, along a cylinder axis;

a piston in each of the cylinders, guided in an axially movable manner; and a common axially actuated piston rod of the pistons, extending through a passage opening in a partition between the at least two working cylinders, wherein the at least two working cylinders are sealed off with respect to one another in a region of the common axially actuated piston rod exclusively by a non-contact seal, the axial seal comprising an axial gap seal formed between a radially outer circumferential surface of the common axially actuated piston rod and a radially inner circumferential surface of the passage opening, and wherein the reciprocating-piston compressor is a reversing reciprocating-piston compressor, a leakage flow flowing through the axial gap seal from one into another of the at least two working cylinders increasing an air volume compressed during subsequent reversing movement of the axially actuated piston rod.

5. The compressed-air-actuated brake system as recited in claim 4, wherein the reciprocating-piston compressor is a multi-stage reciprocating-piston compressor for performing multi-stage compression, each working cylinder of the multi-stage reciprocating-piston compressor being assigned to a compression stage.

6. The compressed-air-actuated brake system as recited in claim 4, further comprising radial grooves arranged with an axial spacing relative to one another, disposed on the radially inner circumferential surface of the passage opening, to form a labyrinth gap seal.

* * * * *